United States Patent [19]

Sawada et al.

[11] 4,159,013

[45] Jun. 26, 1979

[54] SPARK TIMING CONTROL DEVICE FOR USE IN INTERNAL COMBUSTION ENGINES

[75] Inventors: Daisaku Sawada; Takashi Shigematsu; Yuji Takeda, all of Susono, Japan

[73] Assignee: Toyota Jidosha Kogyo Kabushiki Kaisha, Aichi, Japan

[21] Appl. No.: 716,576

[22] Filed: Sep. 3, 1976

[30] Foreign Application Priority Data

May 6, 1976 [JP] Japan ..... 51-50895

[51] Int. Cl.[2] ..... F02P 5/04

[52] U.S. Cl. ..... 123/117 A

[58] Field of Search ..... 123/117 A

[56] References Cited

U.S. PATENT DOCUMENTS

| | | | |
|---|---|---|---|
| 3,865,089 | 2/1975 | Eichler et al. | 123/117 A |
| 3,905,342 | 9/1975 | Kobayashi et al. | 123/117 A |
| 3,913,540 | 10/1975 | Hayashi | 123/117 A |
| 3,930,515 | 1/1976 | Kennedy et al. | 123/117 A |
| 3,973,533 | 8/1976 | Arano | 123/117 A |
| 4,064,894 | 12/1977 | Ludwig | 123/117 A |

*Primary Examiner*—Ronald B. Cox

*Attorney, Agent, or Firm*—Stevens, Davis, Miller & Mosher

[57] ABSTRACT

A spark timing control device for use in an internal combustion engine, which includes a pressure control valve wherein when an input vacuum is not higher than a given vacuum level, an output vaccum remains at a zero level, and when the input vacuum is not lower than the given level, the output vacuum will be a product of a proportional constant and the difference between the input vacuum and the aforesaid given vacuum level; a pressure source; and a vacuum advance control mechanism. The pressure source is connected to the input side of the pressure control valve, while the output side of the pressure control valve is connected to the vacuum advance control mechanism.

Various modifications of the pressure control valve employable in the spark timing control device are also presented.

1 Claim, 13 Drawing Figures

SPARK TIMING CONTROL DEVICE FOR USE IN INTERNAL COMBUSTION ENGINES

BACKGROUND OF THE INVENTION

1. Field of the Invention

This invention relates to a spark timing control device for use in an internal combustion engine, which device utilizes a vacuum for obtaining a spark advance, and more particularly to a spark timing control device which permits spark-timing control even during engine braking and starting of an automobile.

2. Description of the Prior Art

A prior art vacuum advance control mechanism for use in an internal combustion engine is directly connected to a specific port on the side of an internal combustion engine. The spark timing is advanced in response to a given level of a vacuum fed to the vacuum advance control mechanism. However, adjustment of the given level of a vacuum dictates modification of a vacuum advance control mechanism, and in addition, difficulty is confronted with modification of a spark timing control mechanism.

Furthermore, a prior art spark timing control device is designed to control spark timing, when a throttle valve is at its idling opening, as well as when the throttle valve assumes an opening larger than the idling opening, although the above spark timing control device is not intended to control spark timing during engine braking and starting of an automobile. This results in an increase in the amount of harmful constituents in the exhaust gases, as well as fuel consumption.

SUMMARY OF THE INVENTION

It is an object of the present invention to provide a spark timing control device which may freely control a degree of spark advance, while retaining a prior art vacuum advance control mechanism which controls the spark timing in response to a vacuum fed thereto.

It is another object of the present invention to provide a spark timing control device for use in an internal combustion engine, which device may control spark timing even during engine braking and starting of an automobile.

According to the present invention, there is provided a spark timing control device for use in an internal combustion engine, which comprises a pressure control wherein when an input vacuum is not higher than a given vacuum level, an output vacuum remains at a zero level, and when an input vacuum is not lower than the aforesaid given level, the output vacuum will be a product of a proportional constant and the difference between the input vacuum and the aforesaid given level; a vacuum source; and a vacuum advance control mechanism; the aforesaid vacuum source being connected to the input side of the pressure control valve, with the output side of the pressure control valve being connected to the vacuum advance control mechanism.

According to another aspect of the present invention, the vacuum advance control device further includes a pressure responsive valve provided with an intake port adapted to admit a vacuum developing in an intake system, a first input port, a second input port, an output port and a control vacuum port, whereby the aforesaid pressure responsive valve may selectively connect the first input port to the output port in response to a vacuum being supplied to the control vacuum port.

DESCRIPTION OF THE PREFERRED EMBODIMENTS

Before going further into description of the spark timing control device according to the present invention, several kinds of pressure control valves for use in the embodiments of the present invention will be described.

Figure 1:
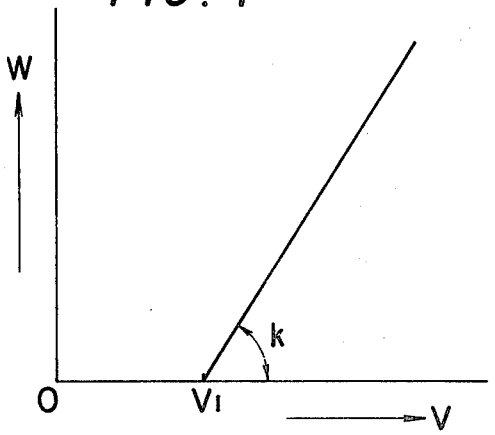
FIG. 1 is a plot showing characteristics of a pressure control valve for use in embodiments of the present invention.
Figure 2:
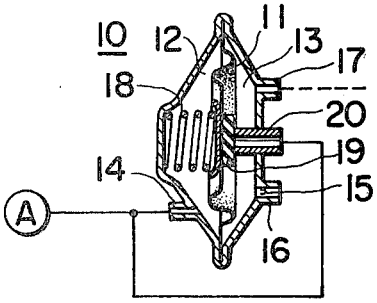
FIGS. 2 to 4 and 6 are cross-sectional views of pressure control valves for use in embodiments of the present invention.

A relationship between an input vacuum V, an output vacuum W and a vacuum VI will be explained with reference to FIGS. 1 and 2. Defined by an input vacuum V as used herein is a vacuum to be taken out from a vacuum source A and applied to a control chamber 12 as well as to an input port 20, as shown in FIG. 2. Defined by an output vacuum W is a vacuum to be taken out through an output port 17, and defined by V1 is a vacuum prevailing in the control chamber 12, at a level of which a valve body 19 is about to be detached from the inner end of the input port 20, i.e., a force equal to a force of a spring 18 urging the valve body 19 against the inner end of the input port 20, the former force having a direction opposite to that of an urging force of the spring 18. Stated otherwise, the vacuum V1 is a point, at which the output vacuum W begins developing at the output port 17, as shown in FIG. 1. Thus, the aforesaid relationship may be expressed as:

When $V \leqq V1$, $W = O$

When $V \geqq V1$, $W = k\,(V - V1)$, wherein K represents a proportional constant.

The arrangements of the pressure control valves having the relationship as shown in FIG. 1 will be described by referring to FIGS. 2 to 6.

Referring to FIG. 2, a pressure control valve 10 includes a control chamber 12 and a pressure chamber 13 which are partitioned by a diaphragm 11. The control chamber 12 is equipped with a control port 14, while the pressure chamber 13 is equipped with a port 16 having an orifice 15, and an output port 17. The diaphragm 11 is maintained in its neutral position under the action of a spring 18. Secured to the diaphragm 11 within the pressure chamber 13 is a valve body 19, which controls connection of an input port 20 to an output port 17. The control port 14 and input port 20 are connected to a common vacuum source A, with the port 16 being communicated with the atmosphere.

A force urging the diaphragm 11 to the left as viewed in FIG. 2 is a force V, i.e., a vacuum prevailing in the control chamber 12. On the other hand, a force to urge the diaphragm 11 to the right is the sum of a vacuum W at the output port 17, i.e., a vacuum prevailing in the pressure chamber 13, and a force F of the spring 18, which urges the valve body 19 to the right. As a result, when the diaphragm 11 is maintained in equilibrium in its neutral position, the relationship $V=W+F$ may be established.

When the vacuum V in the control chamber 12 is no higher than V1, $V \leqq F$. Accordingly, the valve body 19 closes the input port 20 as shown, so that the output port 17 communicates only with the port 16. Thus, a vacuum to be taken out through the port 17 maintains a zero level.

When the vacuum V in the control chamber 12 is not lower than V1, $V \geqq F$, so that the diaphragm 11 is deflected against a force of the spring 18 toward the side of the control chamber 12. As a result, the valve body 19 is detached from the input port 20, so that the output port 17 communicates with the input port 20. However, when $W>V-F$, the diaphragm 11 is returned to its neutral position, while the input port 20 is closed, so that the vacuum W to be taken out through the output port 17 will be $V-F$, eventually.

With the pressure control valve 10, if a spring constant of the spring 18 is suitably selected, then the point V1, at which the output vacuum begins to develop, may be changed.

Figure 3:
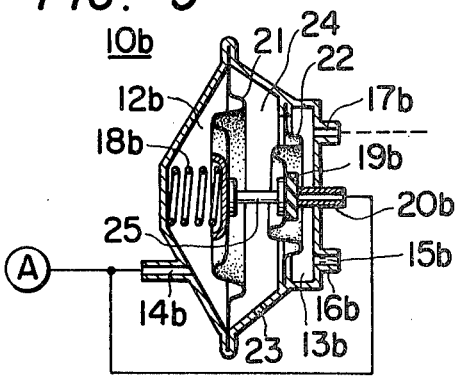

FIG. 3 shows another embodiment of the pressure control valve. Like parts are designated by like reference numerals each having a suffix b in correspondence to FIG. 1. The pressure control valve **10*b* is equipped with a diaphragm 21 defining a control chamber 12*b* and a diaphragm 22 defining a pressure chamber 13*b*. The diaphragms 21 and 22 define an atmospheric pressure chamber 24 therebetween, which is communicated through a port 23 to the atmosphere, and are spaced a given distance from each other by means of a supporting member or spacer 25. With the pressure control valve 10*b*, if a ratio in area of the diaphragm 21 to the diaphragm 22 is suitably selected, then a gradient k in FIG. 1** may be varied.

Figure 4:
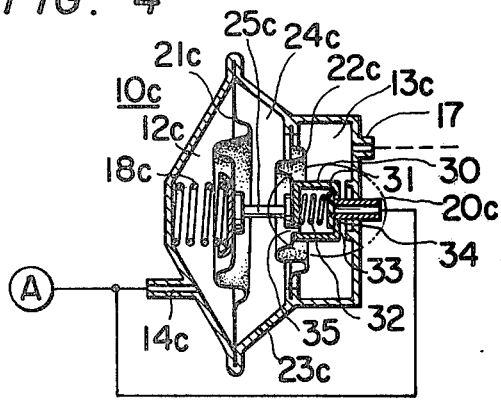
Figure 5:
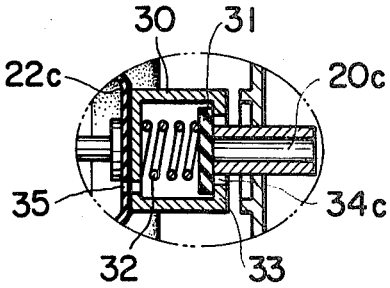
FIG. 5 is a partial enlarged view of the particular port of FIG. 4.

FIG. 4 shows another modification of the pressure control valve of FIG. 3. Like parts are designated like reference numerals each having a suffix c in correspondence with FIG. 3. A cylindrical member 30 is secured to the central portion of a diaphragm 22, while a valve body 31 having a diameter smaller than the inner diameter of the cylindrical member 30 is positioned within the cylindrical member 30. The valve body 31 is brought into abutment with an inner surface 33 of the cylindrical member 30 in its neutral position, by means of a spring 32, as shown. The inner surface 33 of the cylindrical member 30 and an end portion 34 of an input port **20*c* serve as valve seats for the valve body 31. The interior of the cylindrical member 30 is communicated through a relief port 35 with the atmosphere. The advantages of the pressure control valve of FIG. 4 are different from those of the pressure control valve of FIG. 3 in that when a vacuum in the control chamber 12*c* is varied from a high level to a low, i.e., towards an atmospheric pressure, then the diaphragm 22*c* is deflected to the right as viewed in the drawing. However, at this time, as best shown in FIG. 5, the valve body 31 remains in abutment with the end portion 34 of the port 20*c* and is thus prevented from moving to the right, while the inner surface 33 of the cylindrical member 30 may go beyond the end portion 34 of the part 20, so that the inner surface 33 is detached from the valve body 31, thereby providing a gap therebetween. Then, an atmospheric pressure is introduced through the relief port 35 into the pressure chamber 13*c*, whereupon a vacuum being taken out through the output 17*c*** may be rapidly shifted to a suitable vacuum level.

Figure 6:
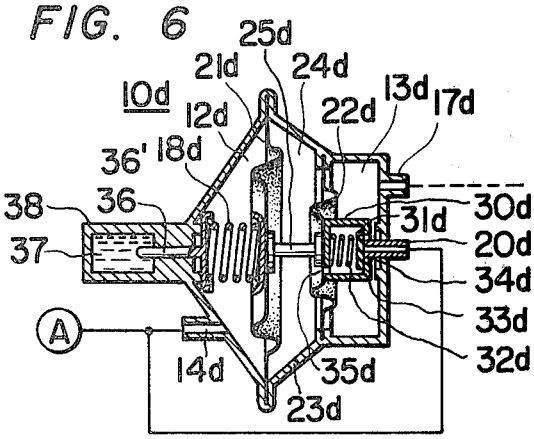

FIG. 6 is still another modification of the pressure control valve of FIG. 4. Like parts are designated by like reference numerals each having a suffix d in correspondence with the valve of FIG. 4.

A spring **18*d* maintains a diaphragm 21*d* in its neutral position, being secured at its one end to the diaphragm 21*d* and at the other end to a plate 36' integral with a rod 36. One end of the rod 36 extends through a container 38 containing wax 37** therein.

The wax 37 expands with an increase in temperature, thereby forcing the rod 36 to the right as viewed in FIG. 6. As a result, the spring **18*d* will be further compressed, while maintaining the diaphragm 21*d*** in its neutral condition, in response to a variation in temperature.

When the pressure control valve **10*d* is connected to a cooling water chamber for use in an internal combustion engine, then there may be obtained an output vacuum from the valve 10*d*** in association with a vacuum and a temperature.

Another spark timing control device according to the present invention will be described with reference to FIG. 7.

Figure 7:
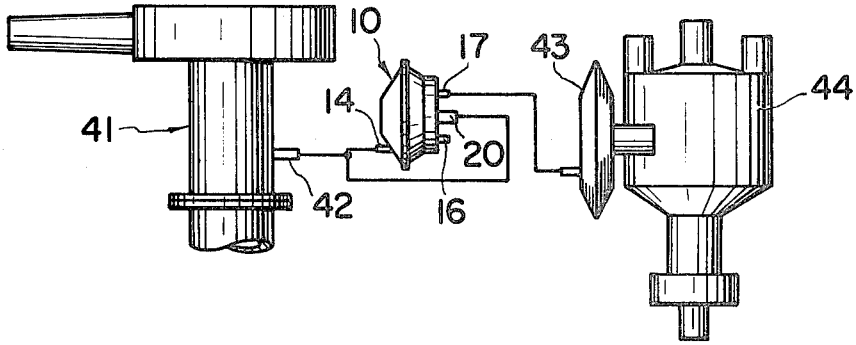
FIG. 7 is a schematic view showing an arrangement of one embodiment of the present invention.

As shown in FIG. 7, there is provided an intake port 42 in an intake system 41 of an internal combustion engine. The intake port 42 detects whether the internal combustion engine is in an idling condition or in an engine-braking condition, being communicated with a control port 14 and an input port 20 in the pressure control valve 10. An output port 17 in the pressure control valve 10 is communicated with a known vacuum advance control mechanism 43. As is well known, the vacuum advance control mechanism 43 is attached to a distributor 44 and thus shifts the position of a distributor body in association with a vacuum which is being supplied thereto.

Figure 8:
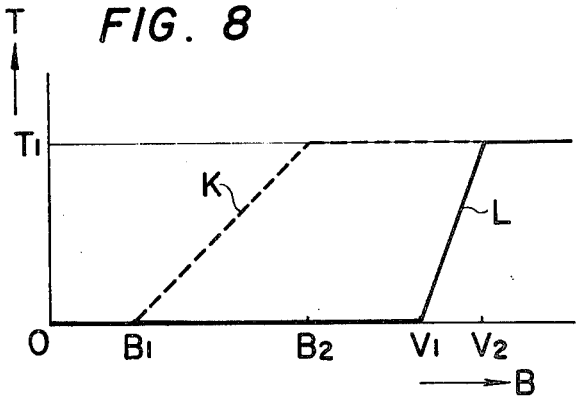
FIG. 8 is a plot showing characteristics of the embodiment of FIG. 7.

FIG. 8 shows the relationship between an intake vacuum B in the intake system 41 and a degree T of a spark advance. In FIG. 8, a broken line represents the relationship K between the intake vacuum B and the degree of a spark advance T, when the intake system 41 is directly connected to the vacuum advance control mechanism 43. According to the relationship K, when the intake vacuum B reaches B1, then the degree T of spark advance begins increasing, and when the intake vacuum B reaches B2, then the spark timing reaches the maximum degree T1 of a spark advance. A solid line represents the relationship L between the intake vacuum B and a degree T of a spark advance, when the pressure control valve 10 is provided between the intake system 41 and the vacuum advance control mechanism 43. This tells that a vacuum being supplied to the vacuum advance control mechanism 43 is maintained at a zero level, until the intake vacuum B reaches the aforesaid vacuum level V1. Thus, there may be obtained a resulting degree T of a spark advance. When the intake vacuum B is higher than V1, a vacuum whose level has been adjusted is fed from the pressure control valve 10 to the vacuum advance control mechanism 43. In this manner, the degree T of a spark advance is progressively increased. When the intake vacuum B reaches V2, then the degree T of a spark advance reaches its maximum value T1.

In this manner, the spark timing control device according to the present invention may set a degree T of a spark advance without modifying a prior art vacuum advance output mechanism as well as pressure control valve 10. As has been described earlier, the value V1 is governed by a spring constant of the spring maintaining the diaphragm in its neutral position. The gradient L for V1–V2 is dependent on a ratio in area of two diaphragms in the pressure control valve.

Meanwhile, the maximum value T1 of the degree T of a spark advance is governed by limitations imposed by the vacuum advance control mechanism 43.

Figure 9:
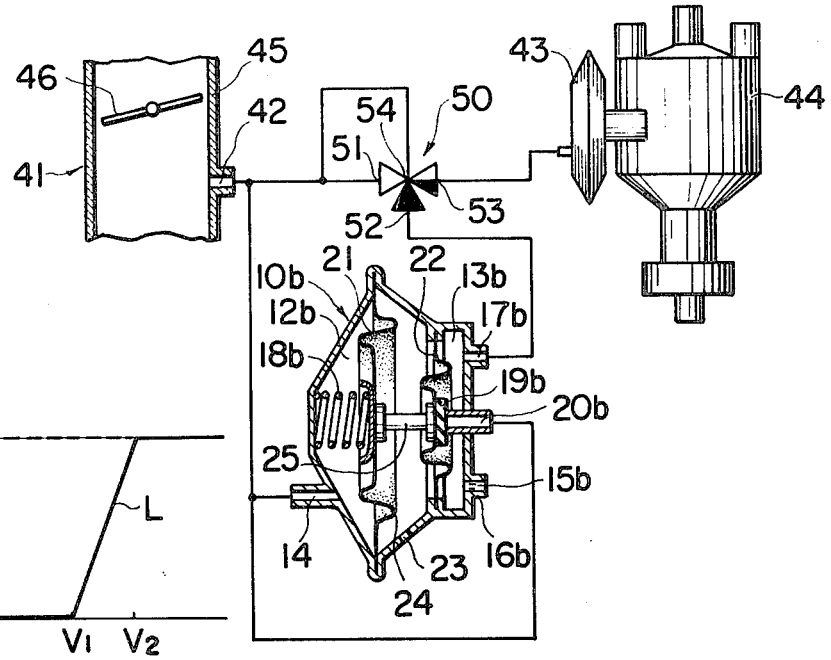
FIG. 9 is a schematic view of another embodiment of the present invention.
Figure 10:
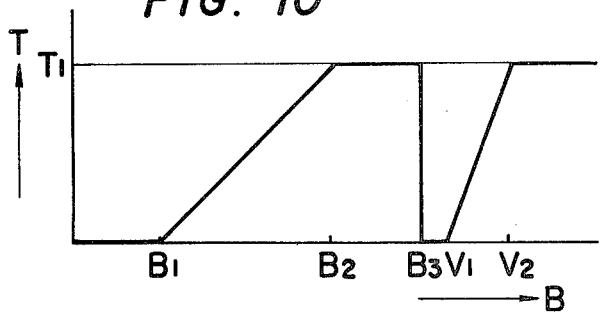
FIG. 10 is a plot showing characteristics of the embodiment of FIG. 9.

As shown in FIG. 9, an intake port 42 in an intake system 41 is positioned downstream of a throttle valve 46 in a carburetor 45. A known type pressure responsive valve 50 is equipped with a first input port 51, a second input port 52, an output port 53 and a control vacuum port 54. When a vacuum to be supplied to the control vacuum port 54 is not higher than B3, then the first input port 51 is brought into communication with the output port 53. When the aforesaid vacuum is not lower than B3, then the second input port 52 is brought into communication with the output port 53. When an automobile having an internal combustion engine of this type starts, the internal combustion engine in its idling condition is engaged with a drive wheel, so that the rpm of the internal combustion engine is decreased temporarily. In other words, an intake vacuum taken out through the intake port 42 will be lower than that at the time of an idling condition. A target value B3 is preset to a value slightly lower than the intake vacuum level. When the throttle valve 46 is opened from its idling opening, then the intake vacuum is necessarily lowered as compared with the value B3. The intake port 42 is connected to the first input port 51 and control vacuum port 54 in the valve 50 as well as to a control port 14*b* and input port 20*b* in the pressure control valve 10*b*. An output port 17*b* in the pressure control valve 10*b* is communicated with a second input port 52 in the valve 50, while an output port 53 is communicated with the vacuum advance control mechanism 43. FIG. 10 shows a relationship between the intake vacuum B being taken out through the intake port 42 and a degree T of a spark advance. When an internal combustion engine is in its idling condition, the throttle valve 46 remains at its idling opening, so that the intake vacuum B to be taken out through the intake port 42 will be as follows: $B3 < B < V1$. As a result, the output port 53 in the valve 50 is brought into communication with the second input port 52. On the other hand, the valve body 19*b* closes the input port 20*b* in the pressure control valve 10*b*. In this manner, an atmospheric pressure is fed through the port 16*b* by way of the output port 17*b* and valve 50 to the vacuum advance control mechanism 43. At this time, the degree T of spark advance remains at a zero level. In a transient condition, upon starting of an automobile, an internal combustion engine is engaged with a drive wheel, with the throttle valve 46 maintained at its idling opening. As a result, the rpm of the internal combustion engine is decreased as compared with that at the time of idling, so that an intake vacuum will be lowered, as compared with B3. In this manner, the first input port 51 is connected to the output port 53 in the valve 50, so that a vacuum is supplied to the vacuum advance control mechanism 43. In other words, the degree T of spark advance is increased.

When the internal combustion engine maintains its braking condition, the intake vacuum exceeds V1. As a result, the output port 53 in the valve 50 is brought into communication with the second input port 52. In addition, the valve body 19*b* in the pressure control valve 10*b* opens the input port 20*b*. In this manner, a vacuum, whose level has been adjusted by the pressure control valve 10*b*, is fed through the valve 50 to the vacuum advance control mechanism 43. In other words, the degree T of spark advance will be increased.

When the throttle valve 46 is further opened from its idling opening, then the intake vacuum B will be lower than B3. As a result, the output port 53 in the valve 50 will be communicated with the first input port 51. In this manner, a vacuum is supplied through the intake port 42 by way of the first input port 51 and output port 53 in the valve 50 to the vacuum advance control mechanism 43. In other words, the degree T of spark advance will be increased. Thus, a spark advance is provided at the time of engine braking, which may prevent an increase in fuel consumption, the amount of harmful constituents of exhaust gases, and overheating of a purifying device or convertor provided in an exhaust system. In addition, spark advance may be achieved when starting an automobile, so that there may be obtained a torque required for starting an automobile.

Figure 11:
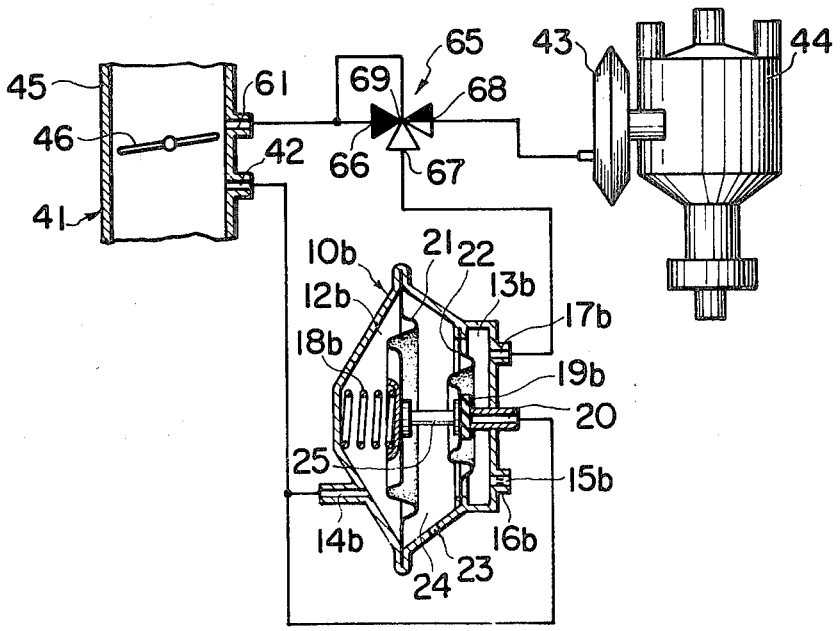
FIG. 11 is a schematic view of still another embodiment of the present invention.

FIG. 11 shows another embodiment of the present invention. An advancer port 61 provided in a carburetor 45 is positioned upstream of a throttle valve 46, when at its idling opening, but downstream of the throttle valve 46, when at an opening larger than an idling opening. The advancer port 61 is connected to a first input port 66 and a control vacuum port 69 in a valve 65. An intake port 42 is connected to a control port 14*b* and an input port 29*b* in the pressure control valve 10*b*. An output port 17*b* is connected to a second input port 67 in the valve 65, while an output port 68 is connected to a vacuum advance control mechanism 43. When a vacuum being supplied to the control vacuum port 69 is lower than C1 in the valve 65, the second input port 67 is brought into communication with the output port 68, and when the vacuum exceeds C1, then the first input port 66 is brought into communication with the output port 68.

When an internal combustion engine remains in its idling condition, the throttle valve 46 remains at its idling opening, while the advancer port 61 is positioned upstream of the throttle valve 46. As a result, a vacuum being supplied to the control vacuum port 69 in the valve 65 is lower than C1, so that the second input port 67 remains connected to the output port 68. In addition, a vacuum of a level lower than C1 is supplied through the intake port 42 to the control chamber 12*b*, so that the input port 20*b* in the pressure control valve 10*b* is closed with the valve body 19*b*. At this time, an atmospheric pressure is supplied through the port 16*b* by way of the second input port 67 and output port 68 in the valve 65 to the vacuum advance control mechanism 43. In other words, the spark timing is maintained in its normal condition.

When the throttle valve 46 is opened at an angle larger than its idling opening, the first input port 66 in the valve 65 remains connected to the output port 68. As a result, a vacuum is supplied through the advancer port 62 by way of the first input port 66 and output port 68 to the vacuum advance mechanism 43. In other words, a spark advance is effected.

When an internal combustion engine is in its engine braking condition, the advancer port 62 is positioned upstream of the throttle valve 61. As a result, the second input port 67 in the valve 65 remains connected to the output port 68. In addition, a vacuum of a level higher than V1 is supplied through the intake port 42 to the control chamber 12*b* in the pressure control valve 10*b*, so that the output port 17*b* is brought into communication with the input port 20*b*. Stated otherwise, a vacuum which has been adjusted by the pressure control valve 10*b* is supplied by way of the output port 17*b* and valve 65 to the vacuum advance control mechanism. Thus, a spark advance is effected.

According to the embodiment of FIG. 11, as in the embodiment of FIG. 9, the spark timing is controlled even when the throttle valve is at an opening larger than its idling opening as well as during engine braking, thereby improving purification of exhaust gases and fuel consumption.

Figure 12:
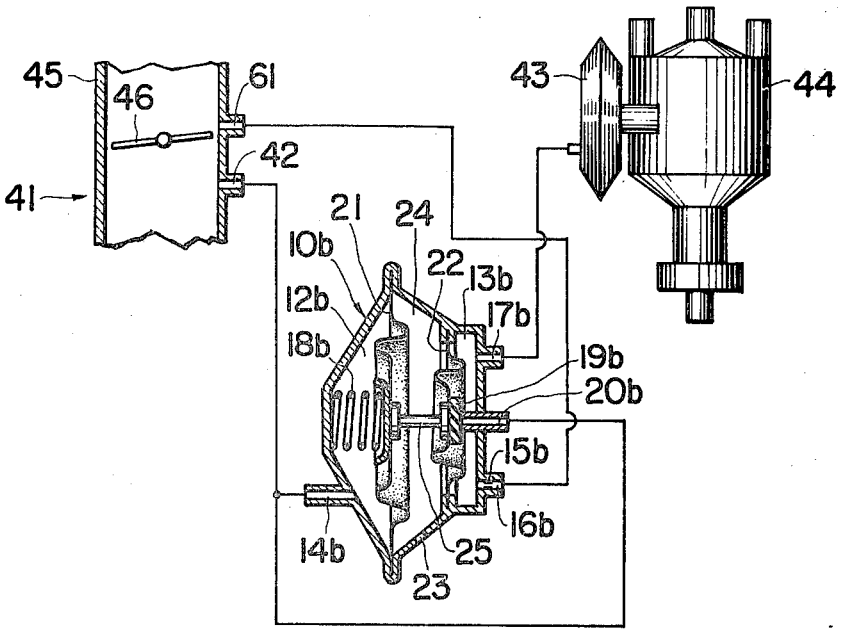
FIG. 12 is a schematic view of yet another embodiment of the present invention.

FIG. 12 shows an embodiment according to the present invention, which dispenses with a valve 65 as in FIG. 11, for providing functions similar to those of the embodiment of FIG. 11. An advancer port 61 is connected to a port 16*b* in a pressure control valve 10*b*. An intake port 42 is connected to a control port 14*b* and input port 20*b* in the pressure control valve 10*b*. An output port 17*b* is connected to a vacuum advance control mechanism 43.

When an internal combustion engine is in its idling condition, a throttle valve 46 remains at its idling opening, so that a vacuum of a level lower than V1 is supplied to the control chamber 12*b*. In this respect, the valve body 19*b* closes an input port 20*b*, so that an atmospheric pressure is fed through the advancer port 17*b* positioned upstream of the throttle valve 46 by ay of the port 16*b* and output port 17*b* to a vacuum advance control mechanism 43. In other words, the spark timing is maintained in its normal condition.

When an internal combustion engine is in an engine braking condition, a vacuum being supplied through the intake port 42 to the control chamber 12*b* is not lower than V1. Thus, the valve body 19*b* opens the input port 20*b*. In this manner, a vacuum, whose level has been adjusted by the pressure control valve 10*b*, is supplied by way of the output port 17*b* to a vacuum advance control mechanism 43. In other words, a spark advance is effected.

When the throttle valve 46 is opened at an angle larger than its idling opening, a vacuum being supplied through the intake port 42 to the control chamber 12*b* is lower than V1. Thus, the valve body closes the input port 20*b*. In this respect, the advancer port 61 is positioned downstream of the throttle valve 46. In this manner, a vacuum is supplied through the advancer port 61 by way of the port 16*b* and output port 17*b* in the pressure control valve 10*b* to a vacuum advance control mechanism 43.

Figure 13:
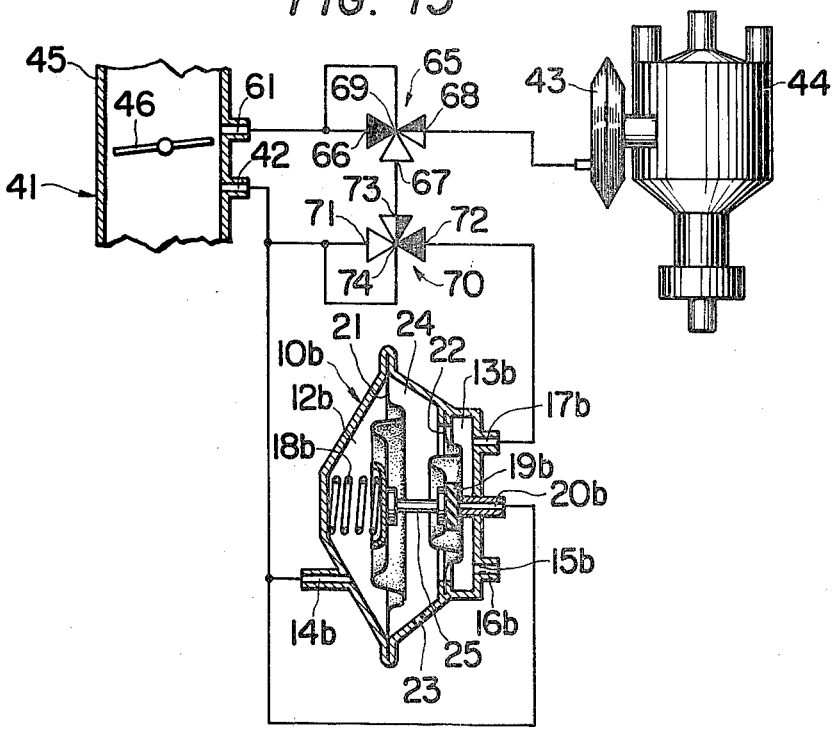
FIG. 13 is a schematic view of a further embodiment of the present invention.

FIG. 13 shows an embodiment similar to FIG. 10, except that a valve 70 is added thereto, thereby enabling a spark timing control during staring of an automobile. Description will be omitted of parts which are common with FIG. 10. An intake port 42 is connected to a first input port 71 and a control vacuum port 74 in the valve 70. An output port 17*b* in the pressure control valve 10*b* is connected to a second input port 72 in the valve 70, while an output port 73 is connected to a second input port 67 in the valve 65. When a vacuum being supplied to the control vacuum port 74 in the valve 70 is not higher than C2 (C2>C1), the first input port 71 is connected to the output port 73. The value C2 is set to a value slightly lower than a vacuum resulting as when the internal combustion engine is in its idling condition.

When an internal combustion engine is in its idling condition, the throttle valve 46 remains at its idling opening, so that the advancer port 61 will be positioned upstream of the throttle valve 46. As a result, the level of a vacuum being taken out through the advancer port 62 will be not higher than C1, while the vacuum being taken out through the intake port 42 will not be lower than C2 nor higher than V1. In this manner, the second input port 67 is connected to the second input port 72 in the valve 70. In addition, the input port 20*b* in the pressure control valve 10*b* is closed with the valve body 10*b*. Thus, an atmospheric pressure is fed through the port 16*b* in the pressure control valve 10*b* by way of valves 70 and 65 to the vacuum advance control mechanism 43. In other words, the spark timing is brought into a normal condition.

When an automobile having an internal combustion engine installed thereon starts, the internal combustion engine is engaged with a drive wheel, with the throttle valve 46 maintained at its idling opening, while the rpm of the engine will be lowered temporarily. Thus, an intake vacuum being taken out through the intake port 42 will not be higher than C2. In addition, the throttle valve 46 remains at its idling opening at this time. In this manner, the second input port 67 is connected to the output port 68 in the valve 65, while the first input port 71 is connected to the output port 73 in the valve 70. At this time, a vacuum (not higher than C2) is fed through the intake port 42 by way of valves 70, 65 to the vacuum advance control mechanism 43. In other words, a spark advance is effected.

When an internal combustion engine is in its engine-braking condition, the vacuum being taken out through the intake port 42 will not be lower than C2 nor lower than V1. As a result, the second input port 67 is connected to the output port 68 in the valve 65, while the second input port 72 is connected to the output port 73 in the valve 70. At this time, the valve body 19*b* opens the input port 20*b* in the pressure control valve 10*b*. In this manner, the input port 20*b* in the pressure control valve 10*b* is brought into communication with the vacuum advance control mechanism 32 by way of valves 70 and 65. In other words, a vacuum, whose level has been adjusted by the pressure control valve 10*b*, is fed to the mechanism 43, so that a spark advance is effected.

When the throttle valve 46 is opened at an angle larger than its idling opening, the advancer port 61 will be positioned downstream of the throttle valve 61. As a result, a vacuum of a level not lower than C1 is supplied to the control vacuum port 69 in the valve 65, so that the first input port 66 is conneted to the output port 68. In this manner, a vacuum is supplied through the advancer port 61 to the vacuum advance control mechanism. In other words, a spark advance is effected.

As is apparent from the foregoing description of the spark timing control device according to the present invention, the spark advance may be achieved even during engine braking, so that there may be achieved lowering or saving in fuel consumption as well as a decrease in the amount of harmful constituents of exhaust gases. Furthermore, the spark advance is effected during starting of an automobile, so that a suitable torque may be obtained.

It will be understood that the adove description is merely illustrative of preferred embodiments of the invention. Additional modifications and improvements utilizing the discoveries of the present invention may be perceived by those skilled in the art from the present disclosure, and such modifications and improvements may fairly be presumed to be within the scope and purview of the invention as defined by the claims that follow.

What is claimed is:

1. A spark timing control device for use in an internal combustion engine, comprising:

an intake passage in said engine provided with an intake port;

a pressure control valve operative so that when an input vacuum applied thereto is not higher than a given vacuum level, an output vacuum therefrom remains at a zero level, and when an input vacuum applied thereto is not lower than said given vacuum level, an output vacuum therefrom will be a product of a proportional constant and the difference between said input vacuum and said given vacuum level;

a vacuum advance control mechanism; and, a pressure responsive valve having a first input port, a second input port, an output port and a control vacuum port, including means for selectively connecting said first input port or said second input port to said output port in response to the magnitude of a vacuum supplied to said control vacuum port, said intake port being connected to said control vacuum port and said first input port in said pressure responsive valve as well as to the input side of said pressure control valve; the output side of said pressure control valve being connected to said second input port in said pressure responsive valve, and said output port in said pressure responsive valve being connected to said vacuum advance control mechanism.

* * * * *